US009476641B2

(12) United States Patent
Chakravarthy et al.

(10) Patent No.: US 9,476,641 B2
(45) Date of Patent: Oct. 25, 2016

(54) DOWN-FLOW CONDENSER REBOILER SYSTEM FOR USE IN AN AIR SEPARATION PLANT

(75) Inventors: Vijayaraghavan S. Chakravarthy, Williamsville, NY (US); John Henri Royal, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 2887 days.

(21) Appl. No.: 11/863,561

(22) Filed: Sep. 28, 2007

(65) Prior Publication Data

US 2009/0084133 A1 Apr. 2, 2009

(51) Int. Cl.
*F25J 3/00* (2006.01)
*F25J 3/04* (2006.01)

(52) U.S. Cl.
CPC ..... *F25J 3/04884* (2013.01); *F25J 3/04412* (2013.01); *F25J 3/04793* (2013.01); *F25J 3/04818* (2013.01); *F25J 2235/50* (2013.01); *F25J 2245/50* (2013.01); *F25J 2250/04* (2013.01); *F25J 2250/20* (2013.01)

(58) Field of Classification Search
USPC ..... 62/643–653
See application file for complete search history.

(56) References Cited

U.S. PATENT DOCUMENTS

| | | | | |
|---|---|---|---|---|
| 5,071,458 | A | 12/1991 | Grenier et al. | |
| 5,122,174 | A | 6/1992 | Sunder et al. | |
| 5,537,840 | A | 7/1996 | Srinivasan et al. | |
| 5,699,671 | A | 12/1997 | Lockett et al. | |
| 5,724,834 | A * | 3/1998 | Srinivasan et al. | 62/643 |
| 5,775,129 | A * | 7/1998 | Satchell et al. | 62/643 |
| 5,901,574 | A * | 5/1999 | Rohde | 62/640 |
| 5,956,972 | A * | 9/1999 | Naumovitz | 62/643 |
| 6,272,884 | B1 | 8/2001 | Billingham et al. | |
| 6,393,864 | B1 * | 5/2002 | Darredeau | 62/643 |
| 6,393,866 | B1 * | 5/2002 | Srinivasan et al. | 62/643 |
| 7,421,856 | B2 * | 9/2008 | Chakravarthy et al. | 62/643 |
| 2007/0028649 | A1 * | 2/2007 | Chakravarthy et al. | 62/643 |

* cited by examiner

*Primary Examiner* — Frantz Jules
*Assistant Examiner* — Melanie Phero
(74) *Attorney, Agent, or Firm* — Robert J. Hampsch; David M. Rosenblum

(57) ABSTRACT

A condenser reboiler system located within a bottom region of a low pressure column of a double column arrangement that is used in an air separation system to separate air. The condenser reboiler system incorporates first and second heat exchangers of the down-flow type that are situated in a side-by-side relationship and with the first heat exchanger being shorter than the second heat exchanger so that the first heat exchanger will remain functional after a shut-down of the air separation system when the second heat exchanger(s) are not capable of operating due to liquid dumping into a sump region of the low pressure column. The side-by-side relationship allows the column to be fabricated without excessive height.

7 Claims, 1 Drawing Sheet

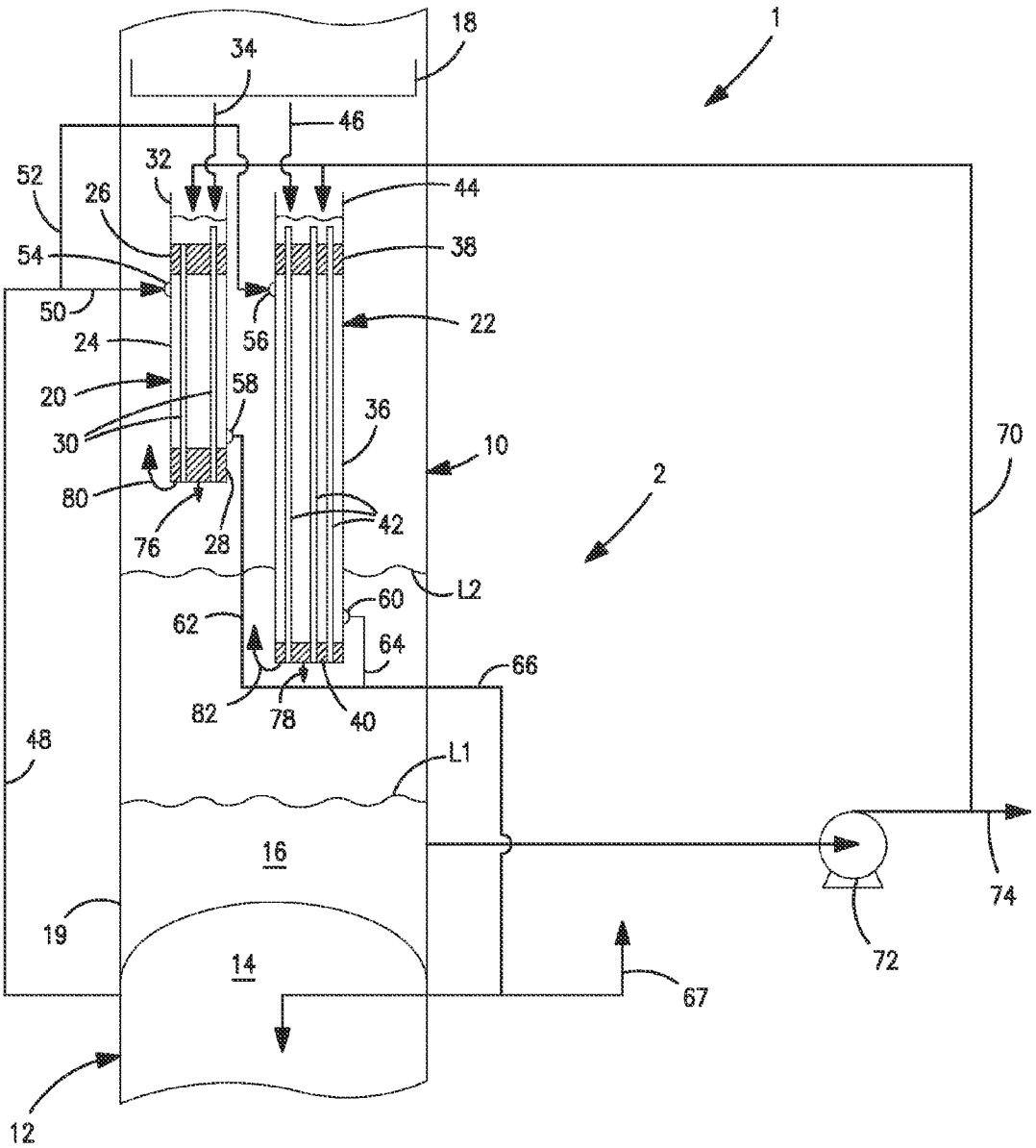
1
18
34
46
32
44
52
26
38
54
50
56
22
24
20
58
36
30
10
70
80
2
76
28
42
L2
60
62
64
66
82
78
40
48
L1
16
74
19
72
14
67
12

DOWN-FLOW CONDENSER REBOILER SYSTEM FOR USE IN AN AIR SEPARATION PLANT

FIELD OF THE INVENTION

The present invention relates to a condenser reboiler system that is used in connection with an air separation plant to condense nitrogen-rich vapor produced as a column overhead of the higher pressure column by partially vaporizing oxygen-rich liquid produced in the lower pressure column. More particularly, the present invention relates to such a system that employs condenser reboilers of the down-flow type and that is designed to permit rapid restart of the air separation plant after a cold shut-down.

BACKGROUND OF THE INVENTION

It has long been known to separate air in an air separation plant that employs cryogenic rectification to separate air into its component parts to produce oxygen, nitrogen and argon products. Typically, the air is compressed and purified of the higher boiling contaminants and is then cooled within a main heat exchanger to a temperature suitable for its rectification within a distillation column.

Air separation plants that are designed to produce oxygen and nitrogen products have high and low pressure columns that are operatively associated with one another in a heat transfer relationship by a condenser reboiler. The incoming compressed and cooled air is introduced into the bottom of the high pressure column to separate the air into a nitrogen-rich vapor column overhead and an oxygen-rich liquid column bottoms also known in the art as crude liquid oxygen or kettle liquid. A stream of the oxygen-rich column bottoms is introduced into the low pressure column in order to separate the stream into an oxygen-rich liquid and a nitrogen-rich vapor, both of which can be taken as the oxygen and nitrogen products, respectively. If argon is a desired product, an argon column can be connected to the low pressure column to separate the argon from an argon-rich stream removed from the low pressure column.

Reflux to both the high and low pressure column is effectuated by condensing the nitrogen-rich vapor developed as column overhead in the high pressure column. This condensation occurs within a condenser reboiler in which an oxygen-rich liquid partially vaporizes against condensing the nitrogen-rich vapor.

There are different designs that are used in the fabrication of such condenser reboilers. In one common design, known as a thermosiphon reboiler, the oxygen-rich liquid collected as column bottoms in the low pressure column partially vaporizes into a two-phase liquid-vapor mixture that is discharged from the reboiler outlet. The density difference provides sufficient liquid head to deliver the column bottoms to the reboiler. There are also down-flow types of reboilers for instance, formed by a brazed aluminum heat exchanger that is fed with the oxygen-rich liquid from a liquid reservoir located at the top of the reboiler. As the oxygen-rich liquid descends within the passages of such a reboiler, it partially vaporizes into liquid and vapor fractions of phases. The passages within such a heat exchanger are formed by parallel sheets of aluminum that are brazed together that have internal fins to increase the heat transfer area. In addition there are reboilers of the down-flow shell and tube design in which tubes are attached to upper and lower tube sheets. A reservoir is located above to distribute the oxygen-rich liquid to the tubes. Inlets and outlets are provided in the shell for the nitrogen-rich vapor to enter the shell and condense through indirect heat exchange with the oxygen-rich liquid. Vapor and liquid phases of the oxygen-rich liquid are discharged from the bottom of the tubes. Down-flow condenser reboilers of both the plate-fin design and the shell and tube design are advantageous in that they permit closer approach temperatures of the liquid and vapor to be brought into indirect heat exchange. This results in a lower compression requirement for the incoming air.

In order for a down-flow condenser reboiler to function, the partially vaporized liquid must be able to be discharged from the bottom of the passages or tubes. However, during a cold plant shut-down, the oxygen-rich liquid present within the lower pressure column will dump into the sump provided at the bottom of the low pressure column resulting in the partial submergence of the down-flow condenser reboiler. While liquid could be dumped to clear the passages or tubes, this represents a loss in refrigeration and in addition, in order to restart the plant, additional liquid might have to be brought in by truck or rail for such purposes.

The problem of restarting an air separation plant after a cold shut-down when down-flow condenser reboilers are used has been addressed in U.S. Pat. No. 5,071,458 wherein an auxiliary condenser reboiler is provided that is located above the main condenser reboiler at a sufficient height in the column that upon plant shut-down, it will not be submerged and the plant can be restarted. The problem with such an arrangement is that the column must be taller to accommodate the auxiliary condenser reboiler. This results in undesirable increased fabrication costs as well as potential problems in shipping longer than average columns.

As will be discussed the present invention provides a condenser reboiler system of the down-flow type that is used in connection with an air separation plant in which the column can be restarted without draining any liquid from the sump and that has as an advantage, among others that will become more apparent hereinafter, a deployment of down-flow condenser reboilers that does not require the column to be enlarged to accommodate an auxiliary condenser reboiler.

SUMMARY OF THE INVENTION

The present invention provides a condenser reboiler system located in a bottom region of a low pressure column of a double column arrangement that is used in an air separation system.

The condenser reboiler system employs first and second heat exchangers to indirectly exchange heat from a nitrogen-rich vapor stream from a high pressure column of the double column arrangement to an oxygen-rich liquid descending within the low pressure column to condense the nitrogen-rich vapor stream and to partially vaporize the oxygen-rich liquid, thereby to initiate the formation of an ascending oxygen-rich vapor phase within the low pressure column and the collection of oxygen-rich liquid phase within a sump region thereof. The first and second heat exchangers are of down-flow configuration and have flow passages open at the bottom thereof to discharge the oxygen-rich liquid phase and the oxygen-rich vapor phase.

The first and second heat exchangers are situated in a side-by-side relationship. The first of the heat exchangers has a length shorter than that of the second of the heat exchangers and is positioned with respect to the second of the heat exchangers such that upon start-up of the air separation system following a cold shut-down thereof, a liquid level of the oxygen-rich liquid dumped into the sump as a result of the cold shut-down is below the first of the heat exchangers to permit start-up of the air separation system while the second of the heat exchangers is at least partially submerged. As a result, the condenser reboiler system of the present invention can be utilized without extending the height of the distillation column.

As indicated above, each of the first and second heat exchangers can be of plate-fin construction or be of tube and shell construction.

The condenser reboiler system can be provided with a flow network having flow conduits arranged to circulate the nitrogen-rich vapor stream to the first and second heat exchangers and to circulate nitrogen-rich condensate composed of the condensed nitrogen-rich vapor from the first and second heat exchangers back to the high pressure column. The flow network can have a recycle conduit to recycle an oxygen-rich liquid stream composed of the oxygen-rich liquid phase from the sump of the low pressure column to the first and second heat exchangers to prevent dry-out of passages located within the first and second heat exchangers. A pump can be provided in flow communication with the recycle conduit to pump the oxygen-rich liquid stream within the recycle conduit. The flow conduits can be configured such that subsidiary feed streams of the nitrogen-rich vapor stream are fed to the first and second heat exchangers in parallel and subsidiary discharge streams of the nitrogen-rich condensate are discharged from the first and second heat exchangers also in parallel.

As can be appreciated in any embodiment there can be a plurality of the first and second heat exchangers.

BRIEF DESCRIPTION OF THE DRAWING

While the specification concludes with claims distinctly pointing out the subject matter that Applicants regard as their invention, it is believed that the invention will be better understood when taken in connection with the accompanying drawing in which the sole FIGURE is a schematic of a condenser reboiler system in accordance with the present invention.

DETAILED DESCRIPTION

With reference to the FIGURE a condenser reboiler arrangement 1 in accordance with the present invention as shown in use in connection with a double column arrangement 2 that would be utilized within an air separation unit. The double column arrangement 2 includes a low pressure column 10 and a high pressure column 12 that are connected to one another. The "high" and "low" pressure columns are so designated herein and in the prior art in that the high pressure column operates at a higher pressure than the low pressure column.

Although not illustrated, but as would be known to those skilled in the art, a compressed and purified stream is introduced into the bottom of high pressure column 12. High pressure column 12 contains mass transfer elements such as sieve trays, structured packing or random packing to bring vapor and liquid phases of the incoming air to be separated into physical contact. The introduction of the compressed and purified air stream initiates the formation of an ascending vapor phase that becomes evermore rich in nitrogen as it ascends within high pressure column 12 to produce a nitrogen-rich vapor within top region 14 of high pressure column 12. The nitrogen-rich vapor is condensed by condenser reboiler system 1 to initiate the formation of a descending liquid phase that becomes evermore rich in oxygen as it descends within high pressure column 12 to produce a crude oxygen column bottoms such as described hereinabove.

Also as not illustrated, but as would be known to those skilled in the art, a stream of the crude liquid oxygen bottoms is further refined within low pressure column 10. Again, although not illustrated, low pressure column 10 would contain similar mass transfer contacting elements such as contained in high pressure column 12. The descending liquid phase becomes evermore rich in oxygen as it descends within low pressure column 10 to produce an oxygen-rich liquid. As will be further discussed, low pressure column 10 is refluxed by a portion of the condensed nitrogen-rich vapor to initiate formation of the descending liquid phase. In the illustrated embodiment, the oxygen-rich liquid is collected within a distributor tray 18 and fed to condenser reboiler system 1 to condense the nitrogen-rich vapor. Partial vaporization of the oxygen-rich liquid produces an oxygen-rich liquid phase 16 that collects within a sump 19 of the low pressure column and an oxygen-rich vapor phase, to be discussed, that initiates formation of the ascending vapor phase within low pressure column 10.

In the illustrated embodiment, condenser reboiler system 1 includes a first heat exchanger 20 and a second heat exchanger 22. Both first heat exchanger 20 and second heat exchanger 22 are of the down-flow type and are of shell and tube construction. It is understood that other known down-flow heat exchangers could be employed, for instance those of plate-fin construction that are fabricated by brazing aluminum plates together. However, in the illustrated embodiment, the first heat exchanger 20 is provided with a shell 24 in which tube sheets 26 and 28 are enclosed and connected. Tube sheets 26 and 28 support tubes 30 forming passages for the oxygen-rich liquid to be partially vaporized. Top section 32 forms a reservoir to collect and introduce a stream 34 of the oxygen-rich liquid that is collected on collection tray 18 into tubes 30 of first heat exchanger 20.

Second heat exchanger 22 is of similar construction to first heat exchanger 20 and is provided with a shell 36, top and bottom tube sheets 38 and 40 to retain tubes 42. A top section 44 extends beyond top tube sheet 38 to produce a reservoir to introduce a stream 46 of the oxygen-rich liquid collected on collection tray 18 into the tubes 42 of second heat exchanger 22.

Condenser reboiler system 1 also includes flow conduits to introduce the nitrogen-rich vapor 14 into first and second heat exchangers 20 and 22. Connected to the top region 14 of high pressure column 12 is a main flow conduit 48 through which a stream of the nitrogen-rich vapor flows. Main flow conduit 48 is branched and has branches 50 and 52 to distribute subsidiary streams of the nitrogen-rich vapor to first heat exchanger 20 and second heat exchanger 22, respectively. In this regard, first heat exchanger 20 has an inlet header 54 connected to branch 50 to allow a subsidiary stream of the nitrogen-rich vapor to be introduced into the shell 24 of first heat exchanger 20. Similarly, second heat exchanger 22 has a header 56 connected to branch 52 to allow another subsidiary stream of the nitrogen-rich vapor to enter a shell 36 of second heat exchanger 22.

As the oxygen-rich liquid descends within tubes 30 of first heat exchanger 20 and the tubes 42 of second heat exchanger 22, the oxygen-rich liquid is partly vaporized through indirect heat exchange with the nitrogen-rich vapor introduced into shells 24 and 36 thereof. The condensate formed of the condensed nitrogen-rich vapor or in other words, a nitrogen-rich liquid is discharged from headers 58 and 60 that are associated with the shells 24 and 36 of first and second heat exchangers 20 and 22, respectively. Connected to headers 58 and 60 are branches 62 and 64 of a main discharge flow conduit 66 that is connected to the top region 14 of high pressure column 12 to introduce reflux into top region 14 of high pressure column 12. Main conduit 66 also has another branch 67 to introduce nitrogen-rich liquid as reflux into low pressure column 10.

As indicated in the description directly above, the subsidiary streams of the nitrogen-rich vapor are fed in parallel to first and second heat exchangers 20 and 22 and the nitrogen-rich liquid is collected as subsidiary streams in parallel and fed back to high pressure column 12 as reflux. It is possible, however, to feed the entire stream of the nitrogen-rich vapor column overhead from high pressure column 12 to first heat exchanger 20 and any oxygen-rich liquid phase remaining from the partial vaporization to be fed to second heat exchanger 22 in series. The condensate formed of the nitrogen-rich vapor could similarly be fed in series to first and second heat exchangers 20 and 22.

It is important that all of the nitrogen-rich vapor that is to be condensed within first and second heat exchangers 20 and 22 be in fact condensed or in other words, it is important to prevent the known undesirable condition known as "dry-out". In order to avoid this problem a stream of the oxygen-rich liquid phase is recycled by way of a recycle conduit 70 from the sump 16 of low pressure column 10 back to the first and second heat exchangers 20 and 22 to ensure that all of the oxygen-rich liquid is not vaporized. Recycle conduit 70 has a pump 72 for such purposes. A stream of the pumped oxygen-rich liquid phase can be taken as a product stream 74 in a manner known in the art.

It is possible to design first and second heat exchangers 20 and 22 so as to prevent such dry-out as has been discussed above and pump 72 would not be used. Additionally, other recirculation devices could be provided such as an ejector that would be used in connection with the pump or a valve to partly vaporize the stream and decrease its density to provide sufficient head for such recirculation.

As stated above, as the oxygen-rich liquid descends within tubes 30 and 42, such oxygen-rich liquid partially vaporizes to produce oxygen-rich liquid phase streams, generally designated by reference numbers 76 and 78 that collects within the sump 19 of low pressure column 10. Additionally, a vapor phase generally designated by reference numbers 80 and 82 is formed that initiates the ascending vapor phase within low pressure column 10 that becomes evermore rich in nitrogen as it ascends within the low pressure column 10 and in particular, the mass transfer contacting elements thereof.

During normal operation, the oxygen-rich liquid phase collected by is at a level that is designated as "L1" in the drawings. However, upon plant shut-down, all of the liquid contained within such mass transfer elements descends within low pressure column 10 or in other words dumps into the sump region 16 to produce a higher level of liquid composed of the oxygen-rich liquid and designated in the FIGURE as level "L2". When the level of liquid rises to "L2", the tubes 42 of the second exchanger 22 will be partially submerged within the oxygen-rich liquid to prevent the heat exchanger 22 from functioning. An analogous situation would occur in a heat exchanger of the down-flow type that was of plate-fin construction. However, since first heat exchanger 20 and second heat exchanger 22 are situated in a side-by-side relationship, first heat exchanger 20 has a length that is shorter than that of the second heat exchanger 22 and is positioned with respect to the second heat exchanger 22 such that during a shut-down, when liquid rises to level "L2", while such liquid will result in second heat exchanger 22 to partly submerge, first heat exchanger 20 will remain clear of the liquid and be capable of functioning. Thus, the liquid need not be drained and during a restart the liquid level "L2" will eventually fall to liquid level "L1" allowing second heat exchanger 22 to again function. In case of the illustrated shell and tube heat exchangers, the preferred positioning of the first and second heat exchangers 20 and 22 result in regions 32 and 44 thereof to be located directly opposite to one another. As can be appreciated, there could be a slight misalignment provided that first heat exchanger 20 was capable of functioning during a liquid level rise occurring during a cold shut-down of the plant. As indicated above, the advantage of such an arrangement is that the low pressure column 10 does not have to be made taller to accommodate the heat exchangers situated one on top of the other rather than side-by-side as illustrated.

It is also to be noted although two heat exchangers, namely a first heat exchanger 20 and a second heat exchanger 22 are illustrated, in most cases, there would be a series of such first heat exchangers 20 and second heat exchangers 22. In this regard, the first heat exchangers 20 could be greater in number than the second heat exchanger 22 so that the heat exchange duty were equally shared between the groups of first and second heat exchangers.

While the present invention has been described with reference to a preferred embodiment, as will occur to those skilled in the art, numerous changes and additions and omissions can be made without departing from the spirit and the scope of the present invention as set forth in the appended claims.

We claim:

1. A condenser reboiler system located in a bottom region of a low pressure column of double column arrangement used in an air separation system, said condenser reboiler system comprising:

first and second heat exchangers to indirectly exchange heat from a nitrogen-rich vapor stream from a high pressure column of the double column arrangement to an oxygen-rich liquid descending within the low pressure column to condense the nitrogen-rich vapor stream and to partially vaporize the oxygen-rich liquid, thereby to initiate the formation of an ascending oxygen-rich vapor phase within the low pressure column and the collection of oxygen-rich liquid phase within a sump region thereof;

the first and second heat exchangers of down-flow configuration and having flow passages open at the bottom thereof to discharge the oxygen-rich liquid phase and the oxygen-rich vapor phase;

the first and second heat exchangers situated in a side-by-side relationship and located in the bottom region of the low pressure column; and the first of the heat exchangers having a length shorter than that of the second of the heat exchangers and being positioned with respect to the second of the heat exchangers such that upon start-up of the air separation system following a cold shut-down thereof, a liquid level of the oxygen-rich liquid dumped into the sump as a result of the cold shut-down is below the first of the heat exchangers to permit start-up of the air separation system while the second of the heat exchangers is at least partially submerged.

2. The condenser reboiler system of claim 1, wherein each of the first and second heat exchangers is of plate-fin construction or of shell and tube construction.

3. The condenser reboiler system of claim 1, wherein the condenser reboiler system has a flow network having flow conduits configured to circulate the nitrogen-rich vapor stream to the first and second heat exchangers and to circulate nitrogen-rich condensate composed of the condensed nitrogen-rich vapor from the first and second heat exchangers back to the high pressure column.

4. The condenser reboiler system of claim 3, wherein the flow network has a recycle conduit, to recycle an oxygen-rich liquid stream composed of the oxygen-rich liquid from the sump of the low pressure column to the first and second heat exchangers to prevent dry-out of passages located within the first and second heat exchangers utilized for condensing the nitrogen-rich vapor stream and a pump in flow communication with the recycle conduit to pump the oxygen-rich liquid stream within the recycle conduit.

5. The condenser reboiler system of claim 4, wherein the flow conduits are configured such that subsidiary feed streams of the nitrogen-rich vapor stream are fed to the first and second heat exchangers in parallel and subsidiary discharge stream of the nitrogen-rich condensate are discharged from the first and second heat exchangers in parallel.

6. The condenser reboiler system of claim 5, wherein each of the first and second heat exchangers is of plate-fin construction or of tube and shell construction.

7. The condenser reboiler system of claim 1, wherein there are a plurality of the first and second heat exchangers.

* * * * *